United States Patent [19]

Esnard

[11] Patent Number: 4,459,744

[45] Date of Patent: Jul. 17, 1984

[54] RAZOR BLADE APPARATUS AND METHOD

[75] Inventor: Miguel H. Esnard, Asheville, N.C.

[73] Assignee: Alan K. Roberts, Roslyn Heights, N.Y.

[21] Appl. No.: 345,575

[22] Filed: Feb. 4, 1982

[51] Int. Cl.[3] ..... B26B 21/16; B26B 21/56

[52] U.S. Cl. ..... 30/49; 30/52; 30/346.5

[58] Field of Search ..... 30/47, 49, 50, 52, 299, 30/32, 283, 346.5, 346.55, 346.6

[56] References Cited

U.S. PATENT DOCUMENTS

| | | | |
|---|---|---|---|
| 1,491,596 | 4/1924 | Everett | 30/346 G X |
| 1,735,140 | 11/1929 | Speirs | 30/49 |
| 4,208,791 | 6/1980 | Van Cleve | 30/49 |

*Primary Examiner*—E. R. Kazenske
*Assistant Examiner*—Douglas D. Watts
*Attorney, Agent, or Firm*—Posnack, Roberts, Cohen & Spiecens

[57] ABSTRACT

A razor blade arrangement is provided, wherein the razor blade is supported for movement between concave and convex configurations. The razor blade is mounted in a cartridge which holds the blade flexed in convex configuration. The blade is so mounted in the cartridge and the cartridge is so mounted on a handle, that the cartridge-blade assembly may be flexed upon an application of a force on the face thereof. The cartridge-blade assembly is detachably mounted on the handle. The blade is mounted in the cartridge so as to permit relative longitudinal displacement between the blade and cartridge. This movement is afforded by means of providing elongated holes in the blade, which are engaged by pins or pegs forming part of the cartridge. The method of the invention comprises flexing a razor blade between convex and concave shapes in correspondence with the surface to be shaved. The blade is actually flexible in the order of magnitude of about one-eighth of an inch.

12 Claims, 7 Drawing Figures

RAZOR BLADE APPARATUS AND METHOD

FIELD OF INVENTION

This invention relates to safety razors and methods pertaining thereto.

BACKGROUND

A wide variety of safety razors are known and are commercially available, as well as having been the subject of previously issued patents. Some of these patents include U.S. Pat. Nos. 951,456; 967,831; 1,718,188; 1,728,008; 1,735,140; 1,785,190; 2,008,589; and 2,421,205.

L. D. Saxton in U.S. Pat. No. 951,456 reveals a safety razor in which a bed plate curved longitudinally, and having lugs, is combined with a blade adapted to be curved longitudinally, when locked in position, there being provided a guard frame curved longitudinally and having an unobstructed opening between the cutting edge of the blade and the guard teeth. The opening extends the entire length of the cutting edge of the blade and entirely through the guard frame, there being provided sliding lugs cooperating with the lugs on the bed plate to hold the guard and plate together, and there being furthermore provided an arrangement for locking the sliding lugs. As a consequence, the blade is employable in longitudinally curved configuration and to this extent is related to the arrangement of the invention to be shown in greater detail hereinafter. However, the Saxton arrangement does not provide for flexing the blade between alternatively employable positions.

A. Schmitt in U.S. Pat. No. 1,728,008 also reveals a longitudinally curved blade. In this arrangement a flexible razor blade is employed which has a central perforation and an elongated perforation at each lengthwise portion thereof. A pair of supporting plates is provided, one side of each supporting plate being curved sideways, and the other side of the two supporting plates being curved sideways and lengthwise, one of the supporting plates having a threaded stud at its center and a pin at each lengthwise portion. The other supporting plate has a central perforation and a perforation at each lengthwise portion, the opposite longitudinal edges thereof being notched. The pins at the lengthwise portion of the threaded stud-carrying plate pass through the perforation of the razor blade and the perforation of the notched-edge supporting plate. A handle having a threaded bore to receive the threaded stud to draw the parts together is so operable as to curve the flexible razor blade into a fixed configuration and firm contact with the supporting plates. Herein the arrangement is such as to hold the blade in fixed convex shape.

W. I. Ohmer in U.S. Pat. No. 2,008,589 shows the combination of a cap and a guard with a stud depending from the underside of the cap. A blade and a handle are also provided, the handle cooperating with the stud to clamp the parts in assembled relationship. The drawing of this specific patent reveals that the blade may be held in one fixed configuration which is, more specifically, convex and no provision is made for flexing the blade between convex and concave configurations.

Similarly, E. F. Kingsley in U.S. Pat. No. 2,421,205 reveals an arrangement wherein a blade is so clamped between facing members, as to be held in longitudinally curved relationship with the curve being convex in a direction, which is longitudinally extensive along the blade. More particularly, there is provided a handle having a pair of forked arms disposed on one end thereof and having a curved plate joining the arms at the outer ends thereof, there being moreover provided a guard member hingedly attached to one of the arms near a junction with the plate and in spaced relationship with the curved plate. A clamping jaw is attached to the guard to bear against the underside of a razor blade when the guard is in a latched position, the arm opposite the hinge of the guard member having a recess portion connecting the upper portion of the arms and having a spring wire attached to the arm to be pressed against the end of the razor blade when the clamping jaw is closed. This patent, as well as the other patents mentioned hereinabove, fail to reveal the different features of the invention, as will be made clearer hereinafter.

SUMMARY OF INVENTION

It is an object of the invention to provide improved methods and apparatus relating to shaving and, more particularly, to the utilization of razor blades.

It is a further object of the invention to provide improved methods and apparatus for better accommodating razor blades to the surfaces to be shaved.

It is still another object of the invention to provide improved razor blade arrangements, particularly adapted for shaving different types of surfaces, such as convex leg regions and concave armpit regions.

Yet another object of the invention is to provide an improved arrangement wherein razor blades may be supported for flexed movement between concave and convex configurations.

In achieving the above and other objects of the invention, there is provided an arrangement comprising a razor blade and means for supporting the razor blade for movement between and selective operation in concave and convex configurations.

In further accordance with the invention, the aforesaid means includes a handle for manipulation of the razor blade and there is included a cartridge housing the blade and holding the blade flexed in one of the convex or concave configurations, preferably in the convex configuration.

In still further accordance with the invention, the razor blade has a longitudinal axis and is provided with at least one opening elongated in correspondence with this longitudinal axis, the cartridge including a pin or peg displaceable in said opening, as said blade is flexed between said configurations. In a more specific arrangement, the razor blade has a central axis perpendicular to the longitudinal axis and the opening is spaced to one side of the central axis, the blade being provided with a second opening corresponding to the first opening and positioned in mirror image relationship thereto on the other side of the central axis, said cartridge including a second pin displaceable in said second opening.

The blade may, in still further accordance with the invention, be provided with a circular opening on the aforementioned central axis and the cartridge may include a further pin or peg substantially non-displaceably accommodated in the circular opening to prevent displacement of the blade along the longitudinal or central axis. The cartridge will preferably include facing receptacles which are spaced at determinable distance with the cartridge in said one configuration, namely the preferred convex configuration. The aforesaid means will preferably include receptacle engaging elements which are resiliently urged apart to a maximum spacing exceeding the determinable distance, but which can be pushed together to enable engagement in said receptacles upon being released. When the receptacles move apart, as the cartridge is flexed between the aforesaid configurations, the maximum spacing to which the receptacles move, is less than the maximum spacing of the elements thereby preventing detachment of the cartridge from the support.

Preferably the blade in the vicinity of the above-mentioned central axis deflects in the order of magnitude of about one-eighth of an inch when moving between the aforenoted configurations. The cartridge is of a strength sufficient to retain the one configuration in which the blade is maintained and to limit displacement of the elements when engaged by the same. The cartridge and razor blade are of a combined strength, as to be displaceable from the one configuration to the other by a force of at least the order of magnitude of one-half pound applied at least generally in the vicinity of the central axis.

The cartridge is preferably formed of facing and connected halves, at least one of which is provided with openings, and at least one of which is provided with surface notches to enhance flexibility for facilitating movement between the aforenoted configurations. The notches are preferably parallel to the central axis. The openings, in a preferred embodiment, are rectangular and are elongated along the longitudinal axis.

The method of the invention, as will become apparent hereinafter, involves shaving with a razor blade by flexing the blade between convex and concave shapes in correspondence with the surface to be shaved. As noted, the blade may preferably be flexed in the order of magnitude of about one-eighth of an inch.

Other objects, features and advantages of the invention will be found in the detailed description which follows hereinafter, as illustrated in the accompanying drawing.

BRIEF DESCRIPTION OF DRAWING

Figure 4:
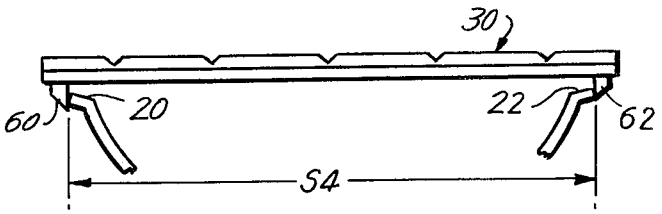
Figure 2:
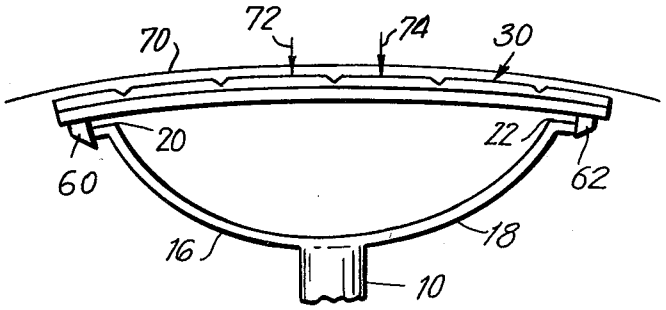
Figure 3:
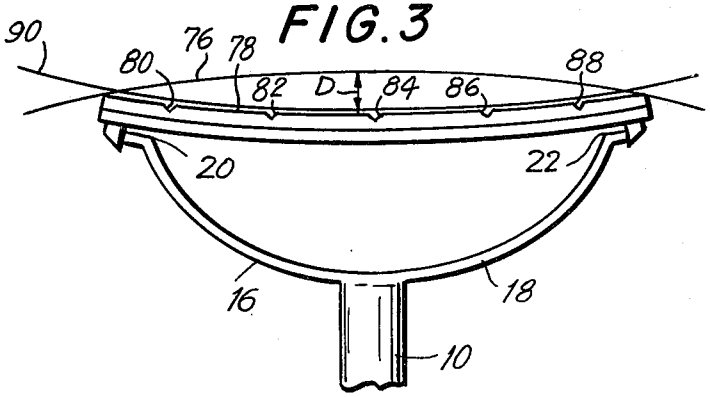
Figure 1:
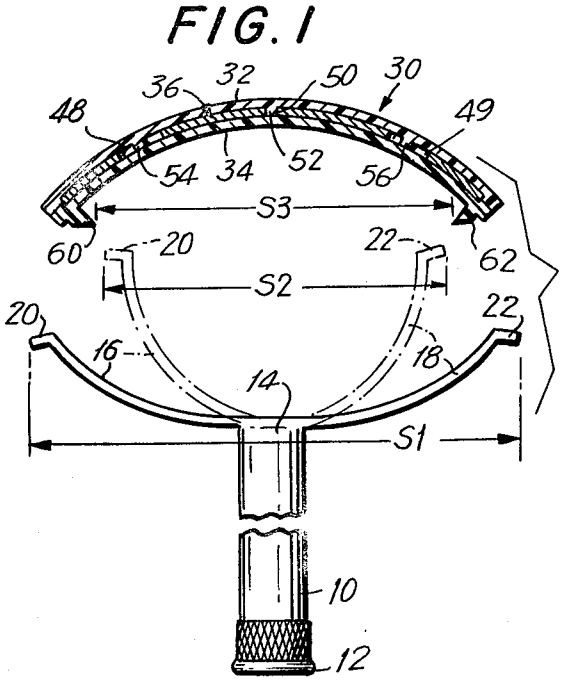
Figure 5:
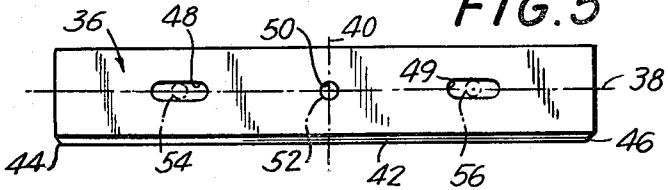
Figure 6:
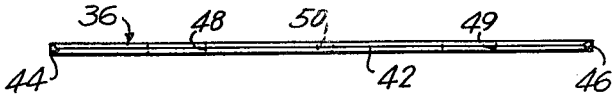

IN THE DRAWING:

FIG. 1 is a side, exploded and partially sectional view of a cartridge including a razor blade in association with a support, as provided in accordance with the invention;

FIG. 2 is a diagrammatic view illustrating the cartridge and blade in convex configuration;

FIG. 3 is a view corresponding to that of FIG. 2 illustrating the cartridge and blade in concave configuration;

FIG. 4 is a view illustrating the cartridge associated with the elements supporting the same with the cartridge being in planar configuration;

FIG. 5 is a top plan view of the razor blade in the cartridge of FIGS. 1–4, the view illustrating the pins of the cartridge in relationship thereto;

FIG. 6 is a side view of the blade illustrated in FIG. 5; and

Figure 7:
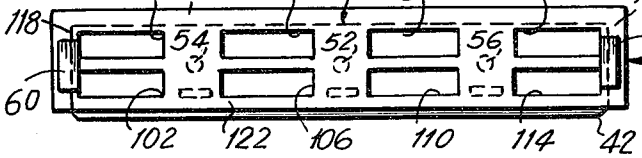

FIG. 7 is a bottom plan of the cartridge of FIGS. 1–4.

DETAILED DESCRIPTION

A conventional razor blade of generally planar configuration will operate satisfactorily with a planar area to be shaved, but will make limited contact with convex and concave shaving areas. A known construction of razor blade whereby the blade is held in convex configuration will make excellent contact with concave shaving areas, but will make limited contact with planar shaving areas and will make very little contact with convex shaving areas.

Insofar as is know, there have not been employed heretofore shaving arrangements wherein the razor blades are maintained in concave configuration so that it is not possible to comment thereupon. As will be shown, however, it is an object of the invention not only to afford concave shaving configurations for razor blades, but for a flexing of a razor blade between concave and convex configurations to allow the razor blade to perform most advantageously despite whichever type of shaving area it encounters. Moreover, as will become apparent, in flexing between the concave and convex shaving configurations, the blade may assume a planar configuration during which period it will be best adapted to operate upon shaving areas which are planar or substantially of such configuration.

In FIG. 1 is shown a handle 10 having an end 12 with a portion 14 distal therefrom. Two arms 16 and 18 stretch out in opposite directions from the portion 14 and are formed of plastic so as to be readily deformable from the shape illustrated in solid lines. At the ends of the arms 16 and 18 are the cartridge receptacle engaging elements 20 and 22, these elements being preferably integral with the plastic or resilient arms 16 and 18, which may, in turn, be resiliently connected to or monolithic with the handle 10. In the normal position of rest of the arms 16 and 18, the outer extremities of the elements 20 and 22 define a distance indicated more specifically at S1.

The arms 16 and 18 are flexible to, for example, the positions illustrated by dotted lines, whereat the elements 20 and 22 are spaced apart by a distance illustrated at S2. The purpose of this displacement will become apparent immediately hereinafter.

In accordance with the invention, there is provided a cartridge 30 consisting of facing halves 32 and 34 which sandwich therebetween a razor blade indicated at 36. The razor blade 36 may be fabricated of stainless steel and may be of a type which is generally commercially available other than is shown, for example, in FIGS. 5 and 6.

In FIGS. 5 and 6 razor blade 36 is shown as having a longitudinal axis 38 and a central axis 40, as well as cutting edge 42. The razor blade ends may be truncated as illustrated at 44 and 46.

In accordance with the invention, the razor blade is provided with two elongated openings 48 and 49, as well as a circular opening 50. The circular opening 50 is preferably symmetrically located on central axis 40 whereas openings 48 and 49 of elongated configuration are mirror images of one another and are equally spaced on opposite sides of central axis 40. A circular pin or peg is accommodated within the circular opening 50 and is nonmoveably positioned therein. This peg is indicated generally at 52. Two additional pegs or pins 54 and 56 are accommodated within elongated openings 48 and 49 and are slideably displaceable therein in a direction corresponding to the direction of extension of the longitudinal axis 38. Pegs 52, 54 and 56 are part of the cartridge 30 mentioned hereinabove with respect to the overall assembly appearing in FIG. 1 and these pins or pegs may be readily visualized therein. The halves 32 and 34 of the cartridge 30 may be bound together such as by welding, cementing or the like, the blade 36 being entrapped therebetween with the aforesaid pins or pegs located in position in the respectively accommodating openings.

The bottom half 34 of the cartridge is provided with spaced open receptacles 60 and 62, the inner edges of these receptacles being spaced apart at a distance S3. The distance S3 is of such a magnitude that when the arms 16 and 18 are moved together to the distance S2, the elements 20 and 22 can be moved by the innermost edges of receptacles 60 and 62 into positions of penetration into the receptacles 60 and 62, which are generally hollow for this purpose. Thereupon, the arms 16 and 18 may be released from the pressure which forces them together and will automatically open to permit the elements 20 and 22 to be received within the receptacles 60 and 62 thereby to support the cartridge in fixed position on the handle 14 for manipulation thereby and for a shaving operation.

The cartridge 30 may be fabricated of a plastic of commercially known type. The strength of the plastic which is mounted to assume normally a convex configuration, as illustrated in FIG. 1, is such as to be able to hold the razor blade 36 in this convex configuration. The combined strength of the cartridge 30 and the razor blade 36 is such that when the arms 16 and 18 are released, the elements 20 and 22 will penetrate into and be accommodated within receptacles 60 and 62 without being able to force the same apart and thereby these arms are unable to exert sufficient force to change the configuration of the cartridge. This relationship and strength can be readily provided by appropriate selection of materials and/or by appropriately providing the arms with a thinness which makes these arms sufficiently weak so that they can perform a supporting function without being able to perform a cartridge deforming function.

FIG. 2 illustrates the handle with arms 16 and 18 having been released so that elements 20 and 22 are received in receptacles 60 and 62. The blade supported in the cartridge 30 is in convex configruation thereby corresponding to the configuration of the surface 70, which is to be shaved. The illustrated configuration of the surface 70 is concave. This surface thus may be, for example, the skin of an armpit or the like, wherein concave surfaces are most likely to occur. The force which is exerted on the cartridge is illustrated by arrows 72 and 74. This force, which will normally be in the order of magnitude of one-half pound or more, will be sufficient to displace the cartridge to a concave configuration, as illustrated in FIG. 3. The displacement is indicated by the distance D, which will be of the order of magnitude of, for example, about one-eighth of an inch, this distance being measured between the bottom of the cartridge indicated at 76 in FIG. 3 and the upper surface of the cartridge, as indicated at 78. To facilitate this displacement, the upper surface 78 is provided with a plurality of notches, such as those shown, by way of example, at 80, 82, 84, 86 and 88. The illustrated number of notches is illustrative only as are the shapes and dispositions thereof. Thus, for example, the illustrated shapes are of a V-configuration with the notches running parallel to the central axis 40 of the blade, as illustrated in FIG. 5.

In the concave configuration illustrated in FIG. 3, the cartridge and blade accommodated therein will be best adapted to serve convex configurations, such as illustrated, for example, at 90. Such convex configurations will generally occur on legs and arms, on chin lines and so forth. It will be appreciated, however, that in passing from the convex configuration illustrated in FIG. 2 to the concave configuration illustrated in FIG. 3, the cartridge and thus the blade will pass through the planar configuration illustrated in FIG. 4 where also appears the cartridge 30, receptacles 60 and 62 and receptacle engaging elements 20 and 22. The inner edges of the elements 60 and 62 will be spaced apart by a distance illustrate at S4 in FIG. 4. At this stage of the change, the distance S4 will be the distance of greatest magnitude existing between elements 60 and 62. It should be noted that the distance S4 will be less than the distance S1 illustrated in FIG. 1. The purpose of this is so that when the cartridge passes through the planar configuration illustrated in FIG. 4, the ends 20 and 22 will be maintained pressed into penetrating relationship into the receptacles 60 and 62 and accordingly the cartridge will not become detached from the handle 10. In this planar configuration, the cartridge and the associated blade will, as has been noted above, be best adapted to service planar surfaces to be shaved.

FIG. 7 illustrates the bottom half 34 of the cartridge 36. Herein it is seen that the bottom half 34 is provided with a plurality of rectangular windows, such as illustrated at 100, 102, 104, 106, 108, 110, 112 and 114. Also will be seen the pins 54, 56 and 52, which are adapted for engaging in the openings 48, 49 and 50 in the blade 36.

The bottom half 34 is moreover provided with upstanding lips or walls 116, 118 and 120 defining an accommodation for the aforesaid blade, which extends past the side 122 thereby to expose effectively the cutting edge for servicing the shaving areas.

In operation, a cartridge, such as cartridge 30 illustrated in FIG. 1, is provided in normally convex shape. It is fastened on to the arms 16 and 18 of handle 10 by pressing these arms resiliently toward each other and then releasing them after the elements 20 and 22 have been moved into position for penetrating into receptacles 60 and 62. The cartridge will be held firmly on the handle 10 where at the same time the arms 16 and 18, for the reasons given above, will not be able to exert sufficient force so as to urge the cartridge 30 into flattened configuration. Shaving will take place initially with the blade in the configuration illustrated in FIG. 2. When sufficient force is exerted, as indicated by arrows 72 and 74, the cartridge and associated blade will pass through the configuration illustrated in FIG. 4, then to assume the maximum concave configuration illustrated in FIG. 3. The cartridge and blade will be able to assume all manners of configuration between the extremities illustrated in FIGS. 2 and 3 and all of this will be effected in accordance with the nature of the surface to be shaved. The peg 52 will be movably located in opening 50, since these elements are of like configuration. Pins or pegs 50 and 56 will slidably displace in openings 48 and 49, as the blade and cartridge move between the concave and convex configurations. The pins will permit longitudinal displacement between the blade and cartridge thereby to enable the flexing of the same. Transverse displacement in directions parallel to central axis 40 will, however, be prevented as this would undesirably expose greater or lesser portions of the cutting edge of the blade to the shaving surface thereby constituting a possible source of injury to the cutting surface. The method of the invention thereby includes the shaving of a suitable surface with a razor blade, which is flexed between convex and concave shapes in correspondence with the surface to be shaved in order to avail the user of corresponding cutting edges and shaving surfaces to permit operation at maximum efficiency.

There will now be obvious to those skilled in the art many modifications and variations of the structure and method set forth hereinabove. These modifications will not, however, depart from the scope of the invention, if defined by the following claims. Thus, for example, the elements 20 and 22 may be urged apart by helical or leaf springs or the like in a totally different arrangement to afford the mounting of the cartridge on handle 10 or the receptacles and receptacle engaging elements may be interchanged with the receptacles being provided on the arms 16 and 18 and the receptacle engaging elements being provided directly on the cartridge. Also, elements 20 and 22 can be permanently attached in receptacles 60 and 62 by cement or transverse pins or the like.

What is claimed is:

1. Apparatus comprising a razor blade, means for supporting said razor blade for movement between and selective operation in concave and convex configurations, said means including a handle for manipulation of said razor blade, and a cartridge housing said blade and holding said blade flexed in one of said configurations, said cartridge being in a corresponding configuration, wherein said razor blade having a longitudinal axis and being provided with at least one opening elongated in correspondence with said longitudinal axis, said cartridge including a pin displaceable in said opening as said blade is flexed between said configurations.

2. Apparatus as claimed in claim 1, wherein said one configuration is the convex configuration.

3. Apparatus as claimed in claim 1, wherein said razor blade has a central axis perpendicular to said longitudinal axis and said opening is spaced to one side of said central axis, said blade being provided with a second opening corresponding to the first said opening and positioned in mirror image relationship thereto on the other side of said central axis, said cartridge including a second pin displaceable in said second opening.

4. Apparatus as claimed in claim 3, wherein said blade is provided with a circular opening on said central axis and said cartridge includes a further pin substantially non-displaceably accommodated in said circular opening.

5. Apparatus as claimed in claim 1, wherein said cartridge includes facing receptacles which are spaced at a determinable distance with said cartridge in said one configuration, said means including receptacle engaging elements which are resiliently urged apart to a maximum spacing exceeding said determinable distance, but which can be pushed together to enable engagement in said receptacles.

6. Apparatus as claimed in claim 5, wherein said receptacles move apart, when said cartridge is flexed between said configurations, to a maximum spacing which is less than the maximum spacing of said elements.

7. Apparatus as claimed in claim 3, wherein said blade, at said central axis, deflects in the order of magnitude of one-eighth of an inch when moving between said configurations.

8. Apparatus as claimed in claim 6, wherein said cartridge is of a strength sufficient to retain said one configuration and to limit displacement of said elements when engaged by the latter.

9. Apparatus as claimed in claim 6, wherein said cartridge and razor blade are of a combined strength as to be displaceable from said one configuration to the other by a force of at least the order of magnitude of one-half pound applied at least generally in the vicinity of said central axis.

10. Apparatus as claimed in claim 9, wherein said cartridge includes facing and connected halves at least one of which is provided with openings and at least one of which is provided with surface notches to enhance flexibility for facilitating movement between said configurations.

11. Apparatus as claimed in claim 10, wherein said notches are parallel to the central axis.

12. Apparatus as claimed in claim 10, wherein the latter said openings are rectangular and are elongated along said longitudinal axis.

* * * * *